US006290468B1

(12) United States Patent
Kato et al.

(10) Patent No.: US 6,290,468 B1
(45) Date of Patent: Sep. 18, 2001

(54) VARIABLE DISPLACEMENT COMPRESSOR

(75) Inventors: Keiichi Kato; Hirotaka Kurakake; Taku Adaniya; Satoshi Inaji, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/429,518

(22) Filed: Oct. 28, 1999

(30) Foreign Application Priority Data

Oct. 30, 1998 (JP) ..... 10-310589
Mar. 30, 1999 (JP) ..... 11-088396

(51) Int. Cl.[7] ..... F04B 1/26
(52) U.S. Cl. ..... 417/222.2; 91/473
(58) Field of Search ..... 417/222.2, 222.1; 137/855, 856; 91/473

(56) References Cited

U.S. PATENT DOCUMENTS

| | | | | |
|---|---|---|---|---|
| 4,702,677 | | 10/1987 | Takenaka et al. | 417/222.2 |
| 4,723,891 | * | 2/1988 | Takenaka et al. | 417/222 |
| 5,318,410 | * | 6/1994 | Kawamura et al. | 417/222.2 |
| 5,567,124 | | 10/1996 | Takenaka et al. | 417/222.2 |
| 5,613,836 | | 3/1997 | Takenaka et al. | 417/222.2 |
| 5,823,294 | * | 10/1998 | Mizutani | 184/6.3 |
| 5,842,835 | * | 12/1998 | Kawaguchi | 417/222.2 |
| 6,102,670 | * | 8/2000 | Taguchi | 417/222.2 |
| 6,109,883 | * | 8/2000 | Kawaguchi | 417/269 |

FOREIGN PATENT DOCUMENTS

| | | | | |
|---|---|---|---|---|
| 255764-A1 | * | 2/1988 | (EP) | 417/222.2 |
| 257784-A1 | * | 3/1988 | (EP) | 417/222.2 |
| 0855506 A2 | | 7/1998 | (EP) | 417/222.2 |
| 10-141223 | | 5/1998 | (JP) . | |
| 11-62823 | | 3/1999 | (JP) . | |

* cited by examiner

*Primary Examiner*—Cheryl J. Tyler
(74) *Attorney, Agent, or Firm*—Morgan & Finnegan, LLP

(57) ABSTRACT

A variable displacement compressor has a housing, which defines a crank chamber, a suction chamber, and a discharge chamber. A bleed passage connects the crank chamber to the suction chamber, which allows gas to flow from the crank chamber to the suction chamber. A release valve, which is a reed valve, is located in the bleed passage. The release valve varies the opening of the bleed passage in accordance with the difference between the pressure in the crank chamber and the pressure in the suction chamber. This can prevent the pressure in the crank chamber from excessively increasing.

20 Claims, 6 Drawing Sheets

VARIABLE DISPLACEMENT COMPRESSOR

BACKGROUND OF THE INVENTION

The present invention relates to a variable displacement compressor for vehicle air-conditioning.

FIG. 8 shows a prior art variable displacement compressor. A drive shaft is rotatably supported in the housing 101, which encloses a crank chamber 102. A lip seal 104 is located between the housing 101 and the drive shaft 103 to prevent leakage of fluid from the housing 101.

An electromagnetic friction clutch 105 is located between the drive shaft 103 and the engine Eg, which serves as a power source. The clutch 105 includes a rotor 106 that is coupled to the engine Eg, an armature 107 that is fixed to the drive shaft 103, and an electromagnetic coil 108. When the coil 108 is excited, the armature 107 is attracted to and contacts the rotor 106. In this state, power of the engine Eg is transmitted to the drive shaft 103. When the coil 108 is de-excited, the armature 107 is separated from the rotor 106, which disconnects the power transmission from the engine Eg to the drive shaft 103.

A lug plate 109 is fixed to the drive shaft 103 in the crank chamber 102. A thrust bearing 122 is located between the lug plate 109 and the housing 101. A swash plate 110 is coupled to the lug plate 109 via a hinge mechanism 111. The swash plate 110 is supported by the drive shaft 103 such that the swash plate 110 slides axially and inclines with respect to the axis L of the drive shaft 103. The hinge mechanism 111 causes the swash plate 110 to integrally rotate with the drive shaft 103. When the swash plate 110 contacts the limit ring 112, the swash plate 110 is positioned at minimum inclination position.

The housing 101 includes cylinder bores 113, a suction chamber 114, and a discharge chamber 115. A piston 116 is accommodated in each cylinder bore 113 and is coupled to the swash plate 110. A valve plate 117 partitions the cylinder bores 113 from a suction chamber 114 and a discharge chamber 115

When the drive shaft 103 rotates, the swash plate 110 reciprocates each piston 116. Accompanying this, refrigerant gas in the suction chamber 114 flows into each cylinder bore 113 through the corresponding suction port 117*a* and suction valve 117*b*, which are formed in the valve plate 117. Refrigerant gas in each cylinder bore 113 is compressed to reach a predetermined pressure and is discharged to the discharge chamber 115 through the corresponding discharge port 117*c* and discharge valve 117*d*, which are formed in the valve plate 117.

An axial spring 118 is located between the housing 101 and the drive shaft 103. The axial spring 118 urges the drive shaft 103 frontward (leftward in FIG. 8) along the axis L and limits axial chattering of the drive shaft 103. A thrust bearing 123 is located between the axial spring 118 and an end surface of the drive shaft 103. The thrust bearing 123 prevents transmission of rotation from the drive shaft 103 to the axial spring 118.

A bleed passage 119 connects the crank chamber 102 to the suction chamber 114. A pressurizing passage 120 connects the discharge chamber 115 to the crank chamber 102. A displacement control valve, which is an electromagnetic valve, adjusts the opening size of the pressurizing passage 120.

The control valve 121 adjusts the flow rate of refrigerant gas from the discharge chamber 115 to the crank chamber 102 by varying the opening size of the pressurizing passage 120. This varies the inclination of the swash pate 110, the stroke of each piston 116, and the displacement.

When the clutch 105 is disengaged, or when the engine Eg is stopped, the control valve 121 maximizes the opening size of the pressurizing passage 120. This increases the pressure in the crank chamber 102 and minimizes the inclination of the swash plate 110. As a result, the compressor stops when the inclination of the swash plate 110 is minimized, or when the displacement is minimized. Accordingly, since the displacement is minimized, the compressor is started when with a minimal torque load. This reduces torque shock when the compressor is started.

When the cooling load on a refrigeration circuit that includes the compressor is great, for example, when the temperature in a vehicle passenger compartment is much higher than a target temperature set in advance, the control valve 121 closes the pressurizing passage 120 and maximizes the displacement of the compressor.

Suppose that when the compressor is operating at maximized displacement, it is stopped by disengagement of the clutch 105 or by shutting off the engine Eg. In this case, the control valve 121 quickly maximizes the opening size of the closed pressurizing passage 120 to minimize the displacement. Also, when the vehicle is suddenly accelerated while the compressor is operating at maximum displacement, the control valve 121 quickly maximizes the opening size of the pressurizing passage 120 to minimize the displacement and to reduce the load applied to the engine Eg. Accordingly, refrigerant gas in the discharge chamber 115 is quickly supplied to the crank chamber 102. Though some refrigerant gas flows to the suction chamber 114 through the bleed passage 119, the pressure in the crank chamber 102 quickly increases.

Therefore, the swash plate 110, when at a minimum displacement position (as shown by the broken line in FIG. 8) is pressed against a limit ring 112. Also, the swash plate 110 pulls the lug plate 109 in a rearward direction (rightward in FIG. 8) through the hinge mechanism 111. As a result, the drive shaft 103 moves axially rearward against the force of the axial spring 118.

When the drive shaft 103 moves rearward, the axial position of the drive shaft 103 with respect to a lip seal 104, which is held in the housing 101, changes. Generally, a predetermined contact area of the drive shaft 103 contacts the lip seal 104. Foreign particles such as sludge exist on the peripheral surface of the drive shaft 103 that is outside the predetermined. Therefore, when the axial position of the drive shaft 103 with respect to the lip seal 104 changes, the sludge will be located between the lip seal 104 and the drive shaft 102. This lowers the sealing performance of the lip seal 104 and may cause leakage of refrigerant gas from the crank chamber 102.

When the operation of the compressor is stopped by the disengagement of the clutch 105 and the drive shaft 103 moves rearward, the armature 107, which is fixed to the drive shaft 103, moves toward the rotor 106. The clearance between the rotor 106 and the armature 107 when the clutch 105 is disengaged is set to a small value, for example, 0.5 mm. Accordingly, when the drive shaft 103 moves rearward, the clearance between the rotor 106 and the armature 107 is eliminated, which causes the armature 107 to contact the rotating rotor 106. This may cause noise and vibration or may transmit power from the engine Eg to the drive shaft 103 regardless of the disengagement of the clutch 105.

When the drive shaft 103 moves rearward, each piston 116, which is coupled to the drive shaft through the lug plate 109 and the swash plate 110, also moves rearward. This moves the top dead center position of each piston 116 toward the valve plate 117, which may permit the pistons 116 to collide with the valve plate 117. Since the control valve 121 maximizes the opening size of the pressurizing passage 120 during sudden accelerations of the vehicle while the compressor is operating, the rearward movement of the drive shaft 103 accompanying the control may cause the pistons 116 to repeatedly collide against the valve plate 117. This generates noise and vibration.

To prevent the rearward movement of the drive shaft 103, the force of the axial spring 118 can be increased. However, increasing the force of the axial spring 118 lowers the durability of the thrust bearing 123, which is located between the axial spring 118 and the drive shaft 103, and lowers the durability of the thrust bearing 122, which is located between the housing 101 and the lug plate 109, and increases the load placed on the engine Eg by the compressor.

SUMMARY OF THE INVENTION

An objective of the present invention is to provide a variable displacement compressor that can prevent the pressure in a crank chamber from excessively increasing.

To achieve the above objective, the present invention provides a variable displacement compressor. The variable displacement compressor includes a housing, a cylinder bore formed in the housing, a crank chamber, a suction chamber, and a discharge chamber. A piston is accommodated in the cylinder bore. A drive shaft is rotatably supported in the housing. A drive plate is coupled to the piston for converting rotation of the drive shaft to reciprocation of the piston. The drive plate is tiltably supported on the drive shaft. The drive plate moves between a maximum inclination and a minimum inclination in accordance with the pressure in the crank chamber. The inclination of the drive plate determines the piston stroke and the displacement of the compressor. A pressure control mechanism controls the pressure in the crank chamber to change the inclination of the drive plate. A control passage connects the crank chamber to a selected chamber in the compressor. A reed valve is located in the control passage. The reed valve varies the opening of the control passage in accordance with the difference between the pressure in the crank chamber and the pressure in the selected chamber, which limits the pressure in the crank chamber.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 2(*b*) is a partial enlarged view showing the open state of the release valve of FIG. 2(*a*);

FIG. 5(*b*) is a front view of the release valve of FIG. 5(*a*);

FIG. 6(*b*) is a front view of the release valve of FIG. 6(*a*);

FIG. 7(*b*) is a partial enlarged cross-sectional view showing the open state of the release valve of FIG. 7(*a*)

DETAILED DESCRIPTION OF THE PREFERRED EMBODIMENTS

A single head type variable displacement compressor for air-conditioning vehicles according to a first embodiment of the present invention will now be described with reference to FIGS. 1–4.

Figure 1:
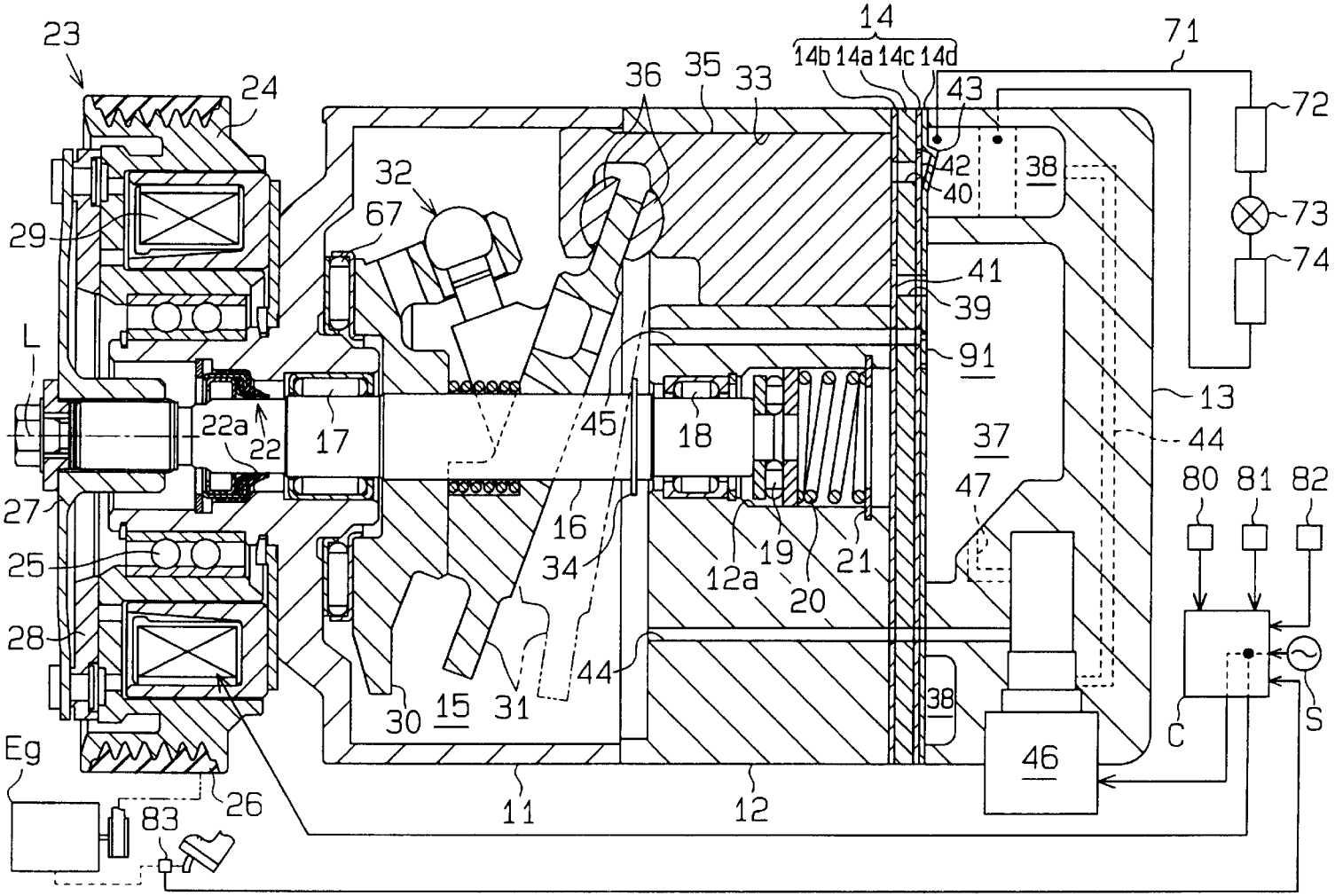
FIG. 1 is a cross sectional view showing a variable displacement compressor according to a first embodiment of the present invention.

As shown in FIG. 1, a front housing member 11 and a rear housing member 13 are coupled to a cylinder block 12. A valve plate 14 is located between the cylinder block 12 and the rear housing member 13. The front housing member 11, the cylinder block 12, and the rear housing member form a compressor housing.

Figure 2B:
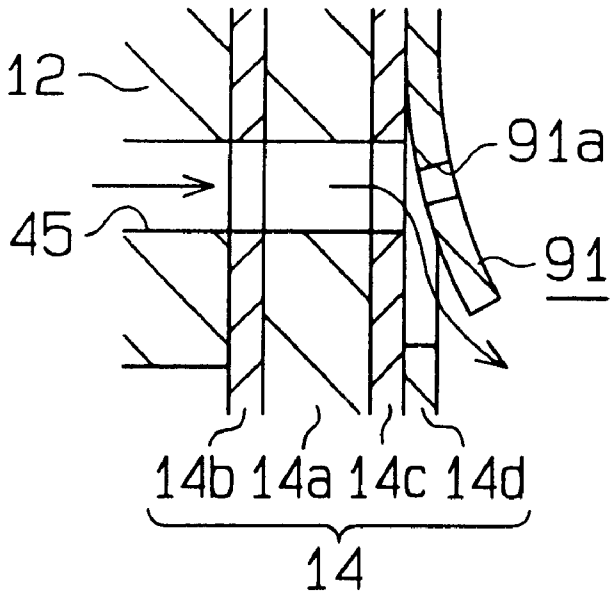
FIG. 2(*a*) is a partial enlarged view showing the release valve of the compressor of FIG. 1.
Figure 2A:
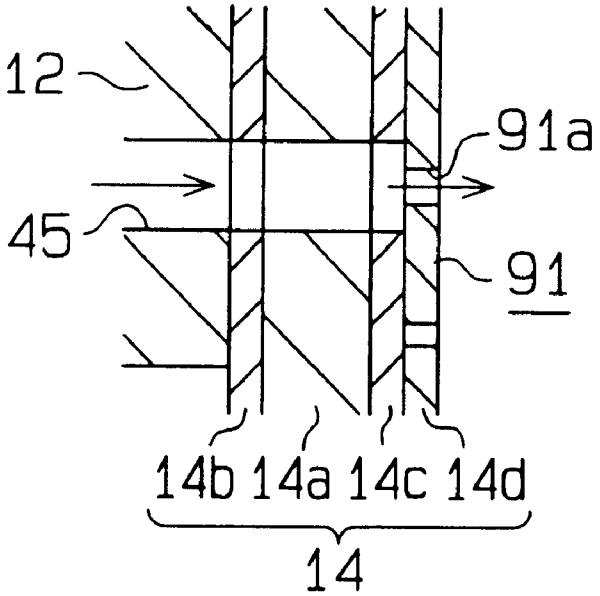

As shown in FIGS. 1 and 2, the valve plate 14 includes a main plate 14*a*, a first sub-plate 14*b*, a second sub-plate 14*c*, and a retainer plate 14*d*. The main plate 14*a* is located between the first sub-plate 14*b* and the second sub-plate 14*c*. The retainer plate 14*d* is located between the second sub-plate 14*c* and the rear housing member 13.

A crank chamber 15 is defined between the front housing member 11 and the cylinder block 12. A drive shaft 16 passes through the crank chamber 15 and is rotatably supported by the front housing member 11 and the cylinder block 12.

The drive shaft 16 is supported in the front housing member 11 through the radial bearing 17. A central bore 12*a* is formed substantially in the center of the cylinder block 12. The rear end of the drive shaft 16 is located in the central bore 12*a* and is supported in the cylinder block 12 through the radial bearing 18. A spring seat 21, which is a snap ring, is fixed to the inner surface of the central bore 12*a*. The thrust bearing 19 and the axial spring 20 are located in the central bore 12*a* between the rear end surface of the drive shaft 16 and the spring seat 21. The axial spring 20, which is a coil spring, urges the drive shaft axially frontward (leftward in FIG. 1) through the thrust bearing 19. The axial spring 20 is an urging member. The thrust bearing 19 prevents transmission of rotation from the drive shaft 16 to the axial spring 20.

The front end of the drive shaft 16 projects from the front housing member 11. A lip seal 22, which is a shaft sealing assembly, is located between the drive shaft 16 and the front housing member 11 to prevent leakage of refrigerant gas along the surface of the drive shaft 16. The lip seal 22 includes a lip ring 22*a*, which is pressed against the surface of the drive shaft 16.

An electromagnetic friction clutch 23 is located between an engine Eg, which serves as an external power source, and the drive shaft 16. The clutch 23 selectively transmits power from the engine Eg to the drive shaft 16.

The clutch 23 includes a rotor 24, a hub 27, an armature 28, and an electromagnetic coil 29. The rotor 24 is rotatably supported by the front end of the front housing member 11 through an angular bearing 25. A belt 26 is received by the rotor 24 to transmit power from the engine Eg to the rotor 24. The hub 27, which has elasticity, is fixed to the front end of the drive shaft 16 and supports the armature 28. The armature 28 is arranged to face the rotor 24. The electromagnetic coil 29 is supported by the front wall of the front hosing member 11 to face the armature 28 across the rotor 24.

When the coil 29 is excited while the engine Eg is running, an attraction force based on electromagnetic force is generated between the armature 28 and the rotor 24. Accordingly, the armature 28 contacts the rotor 24, which engages the clutch 23. When the clutch 23 is engaged, power from the engine Eg is transmitted to the drive shaft 16 through the belt 26 and the clutch 23 (See FIG. 1). When the coil 29 is de-excited in this state, the armature 28 is separated from the rotor 24 by the elasticity of the hub 27, which disengages the clutch 23. When the clutch 23 is engaged, transmission of power from the engine Eg to the drive shaft 16 is disconnected (See FIG. 4).

As shown in FIG. 1, a lug plate 30 is fixed to the drive shaft 16 in the crank chamber 15. A thrust bearing 67 is located between the lug plate 30 and the inner wall of the front housing member 11. A swash plate 31, which serves as a drive plate, is supported on the drive shaft 16 to slide axially and to incline with respect to the drive shaft 16. A hinge mechanism 32 is located between the lug plate 30 and the swash plate 31. The swash plate 31 is coupled to the lug plate 30 through the hinge mechanism 32. The hinge mechanism 32 integrally rotates the swash plate 31 with the lug plate 30. The hinge mechanism 32 also guides the swash plate 31 to slide along and incline with respect to the drive shaft 16. As the swash plate 31 moves toward the cylinder block 12, the inclination of the swash plate 31 decreases. As the swash plate 31 moves toward the lug plate 30, the inclination of the swash plate 31 increases.

A limit ring 34 is attached to the drive shaft 16 between the swash plate 31 and the cylinder block 12. As shown by the broken line in FIG. 1, the inclination of the swash plate 31 is minimized when the swash plate 31 abuts against the limit ring 34. On the other hand, as shown by solid lines in FIG. 1, the inclination of the swash plate 31 is maximized when the swash plate 31 abuts against the lug plate 30.

Cylinder bores 33 are formed in the cylinder block 12. The cylinder bores 33 are arranged at equal annular intervals about the axis L of the drive shaft 16. A single head piston 35 is accommodated in each cylinder bore 33. Each piston 35 is coupled to the swash plate 31 through a pair of shoes 36. The swash plate 31 converts rotation of the drive shaft 16 into reciprocation of the pistons 35.

A suction chamber 37, which is a suction pressure zone, is defined in the substantial center of the rear housing member 13. A discharge chamber 38, which is a discharge pressure zone, is formed in the rear housing member 13 and surrounds the suction chamber 37. The main plate 14*a* of the valve plate 14 includes suction ports 39 and discharge ports 40, which correspond to each cylinder bore 33. The first sub-plate 14*b* includes suction valves 41, which correspond to the suction ports 39. The second sub-plate 14*c* includes discharge valves 42, which correspond to the discharge ports 40. The retainer plate 14*d*includes retainers 43, which correspond to the discharge valves 42. Each retainer 43 determines the maximum opening size of the corresponding discharge valve 42.

When each piston 35 moves from the top dead center position to the bottom dead center position, refrigerant gas in the suction chamber 37 flows into the corresponding cylinder bore 33 through the corresponding suction port 39 and suction valve 41. When each piston 35 moves from the bottom dead center position to the top dead center position, refrigerant gas in the corresponding cylinder bore 33 is compressed to a predetermined pressure and is discharged to the discharge chamber 38 through the corresponding discharge port 40 and discharge valve 42.

A pressurizing passage 44 connects the discharge chamber 38 to the crank chamber 15. A bleed passage 45, which is a pressure release passage, connects the crank chamber 15 to the suction chamber 37. The bleed passage 45 functions as a control passage that connects the crank chamber 15 to a selected chamber in the compressor, which is the suction chamber 37 in this embodiment. A displacement control valve 46 is located in the pressurizing passage 44. The control valve 46 adjusts the flow rate of refrigerant gas from the discharge chamber 38 to the crank chamber 15 by varying the opening size of the pressurizing passage 44. The bleed passage 45 and the control valve 46 form a pressure control mechanism. The pressure in the crank chamber 15 is varied in accordance with the relation between the flow rate of refrigerant from the discharge chamber 38 to the crank chamber 15 and that from the crank chamber 15 to the suction chamber 37 through the bleed passage 45. Accordingly, the difference between the pressure in the crank chamber 15 and the pressure in the cylinder bores 33 is varied, which varies the inclination of the swash plate 31. This varies the stroke of each piston 35 and the displacement.

The control valve 46 will now be described.

Figure 3:
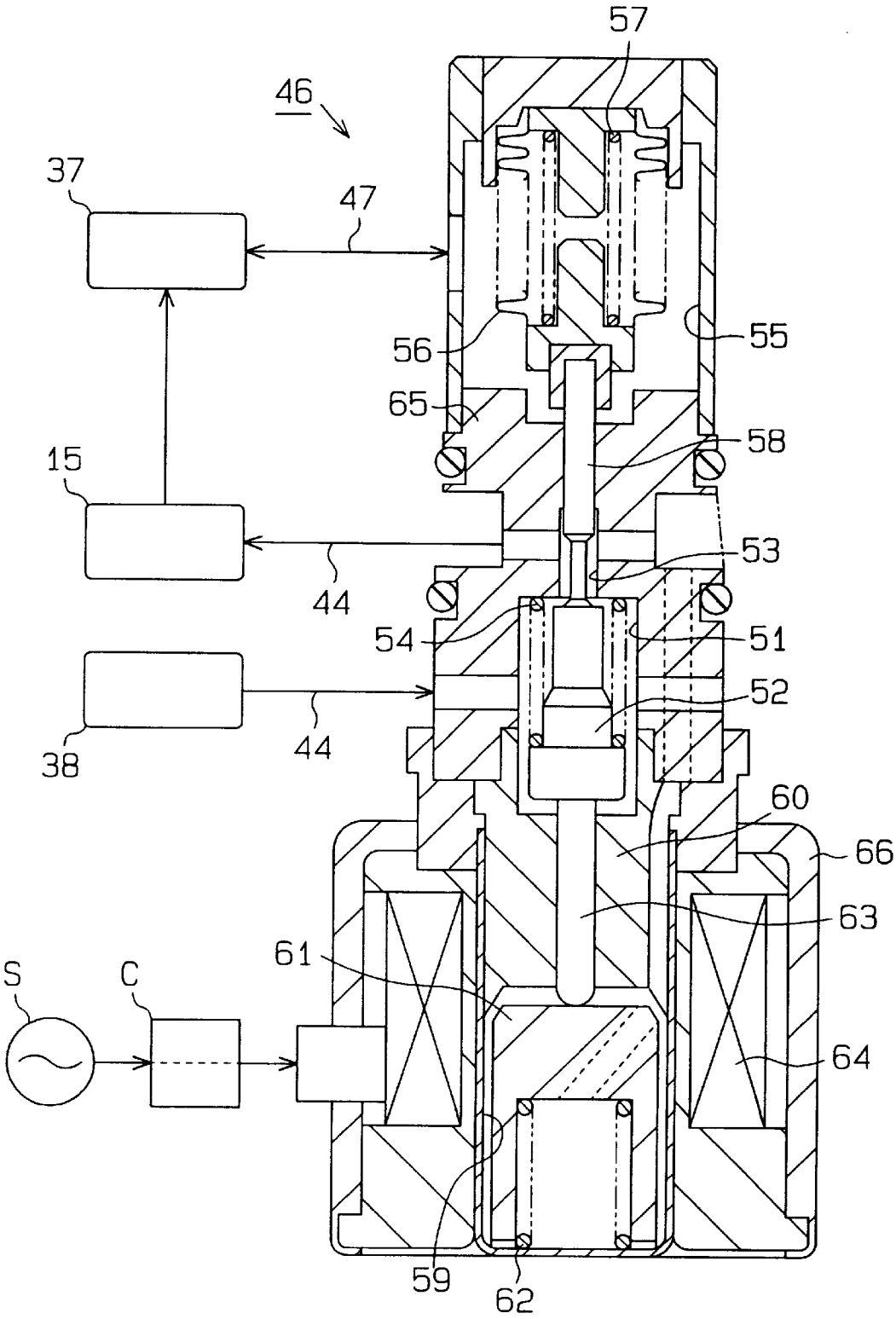
FIG. 3 is a cross sectional view showing the displacement control valve of the compressor of FIG. 1.
Figure 4:
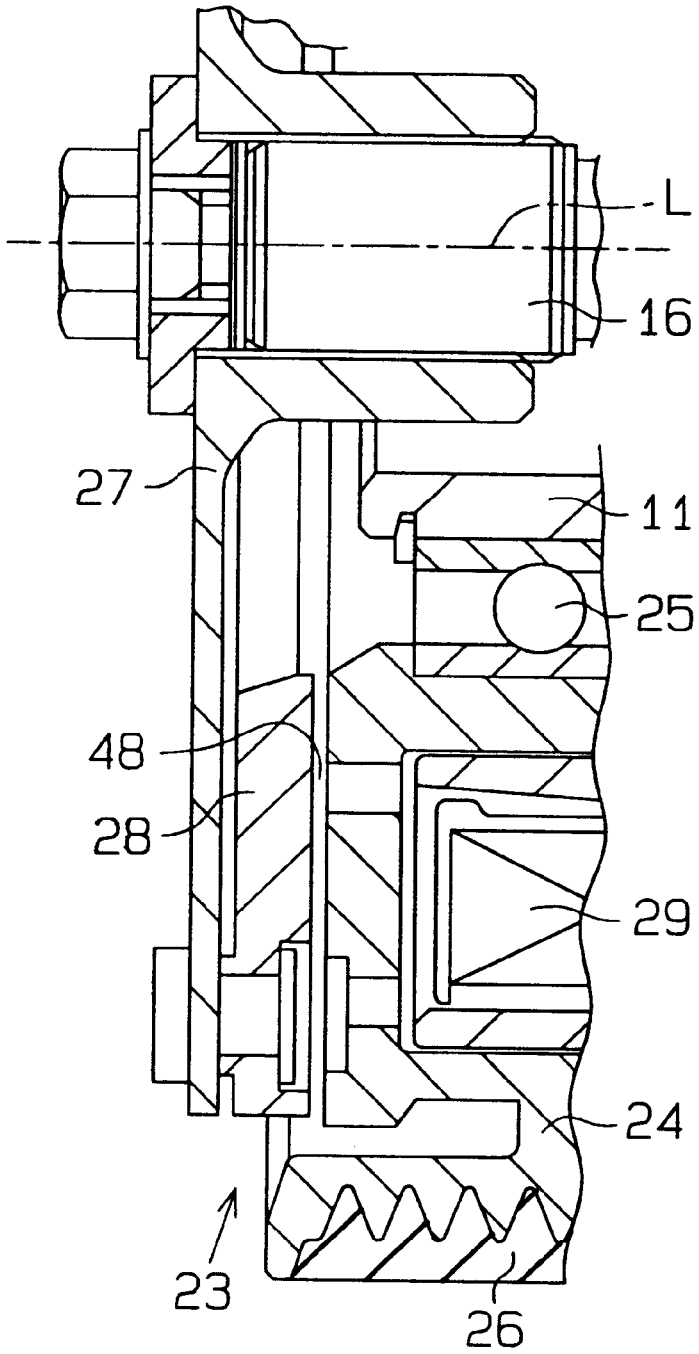
FIG. 4 is a partial enlarged cross-sectional view showing the electromagnetic friction clutch of the compressor of FIG. 1.

As shown in FIG. 3, the control valve 46 includes a valve housing 65 and a solenoid 66, which are coupled together. A valve chamber 51 is defined between the valve housing 65 and the solenoid 66. The valve chamber 51 accommodates a valve body 52. A valve hole 53 opens in the valve chamber 51 and faces the valve body 52. An opener spring 54 is accommodated in the valve chamber 51 and urges the valve body 52 to open the valve hole 53. The valve chamber 51 and the valve hole 53 form part of the pressurizing passage 44.

A pressure sensitive chamber 55 is formed in the valve housing 65. The pressure sensitive chamber 55 is connected to the suction chamber 37 through a pressure detection passage 47. A bellows 56, which is a pressure sensitive member, is accommodated in the pressure sensitive chamber 55. A spring 57 is located in the bellows 56. The spring 57 determines the initial length of the bellows 56. The bellows 56 is coupled to and operates the valve body 52 through a pressure sensitive rod 58, which is integrally formed with the valve body 52.

A plunger chamber 59 is defined in the solenoid 66. A fixed iron core 60 is fitted in the upper opening of the plunger chamber 59. A movable iron core 61 is accommodated in the plunger chamber 59. A follower spring 62 is located in the plunger chamber 59 and urges the movable core 61 toward the fixed core 60. A solenoid rod 63 is integrally formed at the lower end of the valve body 52. The distal end of the solenoid rod 63 continuously abuts against the movable core 61 by the forces of the opener spring 54 and the follower spring 62. In other words, the valve body 52 moves integrally with the movable core 61 through the solenoid rod 63. The fixed core 60 and the movable core 61 are surrounded by a cylindrical electromagnetic coil 64.

As shown in FIG. 1, the suction chamber 37 is connected to the discharge chamber 38 through an external refrigerant circuit 71. The external refrigerant circuit 71 includes a condenser 72, an expansion valve 73, an evaporator 74. The external refrigerant circuit 71 and the variable displacement compressor constitute a refrigeration circuit.

A controller C is connected to an air-conditioner switch 80, which is a main switch of the vehicle air-conditioner, a temperature adjuster 82 for setting a target temperature in a passenger compartment, and a gas pedal sensor 83. The controller C is, for example, a computer, which is located on current supply lines between a power source S (a vehicle battery) and the clutch 23 and between the power source S and the control valve 46. The controller C supplies electric current from the power source S to the electromagnetic coils 29, 64. The controller C controls current supply to each coil 29, 64 based on information including the ON/Off state of the air-conditioner switch 80, a temperature detected by the temperature sensor 81, a target temperature set by the temperature adjuster 82, and the gas pedal depression degree detected by the gas pedal sensor 83.

When the engine Eg is stopped (when the ignition switch is positioned at the accessory off position), most of the current supply to the electric equipment of the vehicle is stopped. Accordingly, the supply of current from the power source S to each coil 29, 64 is stopped. That is, when the operation of the engine Eg is stopped, the current supply lines between the power source S and each coil 29, 64 are disconnected upstream of the controller C.

Operation of the control valve 46 will now be described.

The controller C supplies a predetermined electric current to the coil 29 of the clutch 23 when the air-conditioner switch 80 is turned on during the operation of the engine Eg, and the temperature detected by the temperature sensor 81 is higher than the target temperature set by the temperature adjuster 82. This engages the clutch 23 and starts the compressor.

The bellows 56 of the control valve 46 is displaced in accordance with the pressure in the suction chamber 37, which is connected to the pressure sensitive chamber 55. The displacement of the bellows 56 is transmitted to the valve body 52 through the pressure sensitive rod 58. On the other hand, the controller C determines the electric current value supplied to the coil 64 of the control valve 46 based on the temperature detected by the temperature sensor 81 and the target temperature set by the temperature adjuster 82. When an electric current is supplied to the coil 64, an electromagnetic attraction force in accordance with the value of the current is generated between the fixed core 60 and the movable core 61. The attraction force is transmitted to the valve body 52 through the solenoid rod 63. Accordingly, the valve body 52 is urged to reduce the opening size of the valve hole 53 against the force of the opener spring 54.

In this way, the opening size of the valve hole 53 by the valve body 52 is determined by the equilibrium of the force applied from the bellows 56 to the valve body 52, the attraction force between the fixed core 60 and the movable core 61, and the force of each spring 54, 62.

As the cooling load on the refrigeration circuit increases, for example, as the temperature detected by the temperature sensor 81 becomes higher than the target temperature set by the temperature adjuster 82, the controller C instructs the control valve 46 to increase the current supply to the coil 64. This increases the attraction force between the fixed core 60 and the movable core 61 and increases the force that urges the valve body 52 toward the closed position of the valve hole 53. In this case, the bellows 56 operates the valve body 53 targeting a relatively low suction pressure. In other words, as the current supply increases, the control valve 46 adjusts the displacement of the compressor to maintain a relatively low suction pressure (corresponding to a target suction pressure)

As the opening size of the valve hole 53 is reduced by the valve body 52, the flow rate of refrigerant gas from the discharge chamber 38 to the crank chamber 15 through the pressurizing passage 44 is reduced. On the other hand, refrigerant gas in the crank chamber 15 continuously flows to the suction chamber 37 through the bleed passage 45. This gradually decreases the pressure in the crank chamber 15. Accordingly, the difference between the pressure in the crank chamber 15 and the pressure in the cylinder bores 33 is decreased, which increases the inclination of the swash plate 31 and the displacement of the compressor.

As the cooling load on the refrigeration circuit decreases, for example, as the difference between the temperature detected by the temperature sensor 81 and the target temperature set by the temperature adjuster 82 decreases, the controller C reduces the current supply to the coil 64. This weakens the attraction force between the fixed core 60 and the movable core 61 and reduces the force that urges the valve body 52 toward the closed position of the valve hole 53. In this case, the bellows 56 operates the valve body 52 targeting a relatively high suction pressure. In other words, as the current supply decreases, the control valve 46 adjusts the displacement of the compressor to maintain a relatively high suction pressure (corresponding to a target suction pressure).

As the opening size of the valve hole 53 increases, the flow rate of refrigerant gas from the discharge chamber 38 to the crank chamber 15 is increased, which gradually increases the pressure in the crank chamber 15. This increases the difference between the pressure in the crank chamber 15 and the pressure in the cylinder bores 12*a* and reduces the inclination of the swash plate 31 and the displacement of the compressor.

A structure characteristic of the present embodiment will now be described.

As shown in FIGS. 1, 2(*a*) and 2(*b*), the bleed passage 45 passes through the cylinder block 12 and the valve plate 14 to connect the crank chamber 15 to the suction chamber 37. The bleed passage 45 limits the pressure in the crank chamber 15. A pressure release valve 91 is located at the exit of the bleed passage 45 in the suction chamber 37. The release valve 91, which is a reed valve, is formed on the retainer plate 14*d* of the valve plate 14. The release valve 91 moves between the closed position shown in FIG. 2(*a*) and the open position shown in FIG. 2(*b*), in accordance with the difference between the pressure in the crank chamber 15 and the pressure in the suction chamber 37.

When the difference between the pressure in the crank chamber 15 and the pressure in the suction chamber 37 is smaller than a predetermined value, the release valve 91 is positioned at the closed position shown in FIG. 2(*a*). When the difference between the pressure in the crank chamber 15 and the pressure in the suction chamber 37 is greater than the predetermined value, the release valve 91 is positioned at the open position as shown in FIG. 2(*b*).

Figure 8:
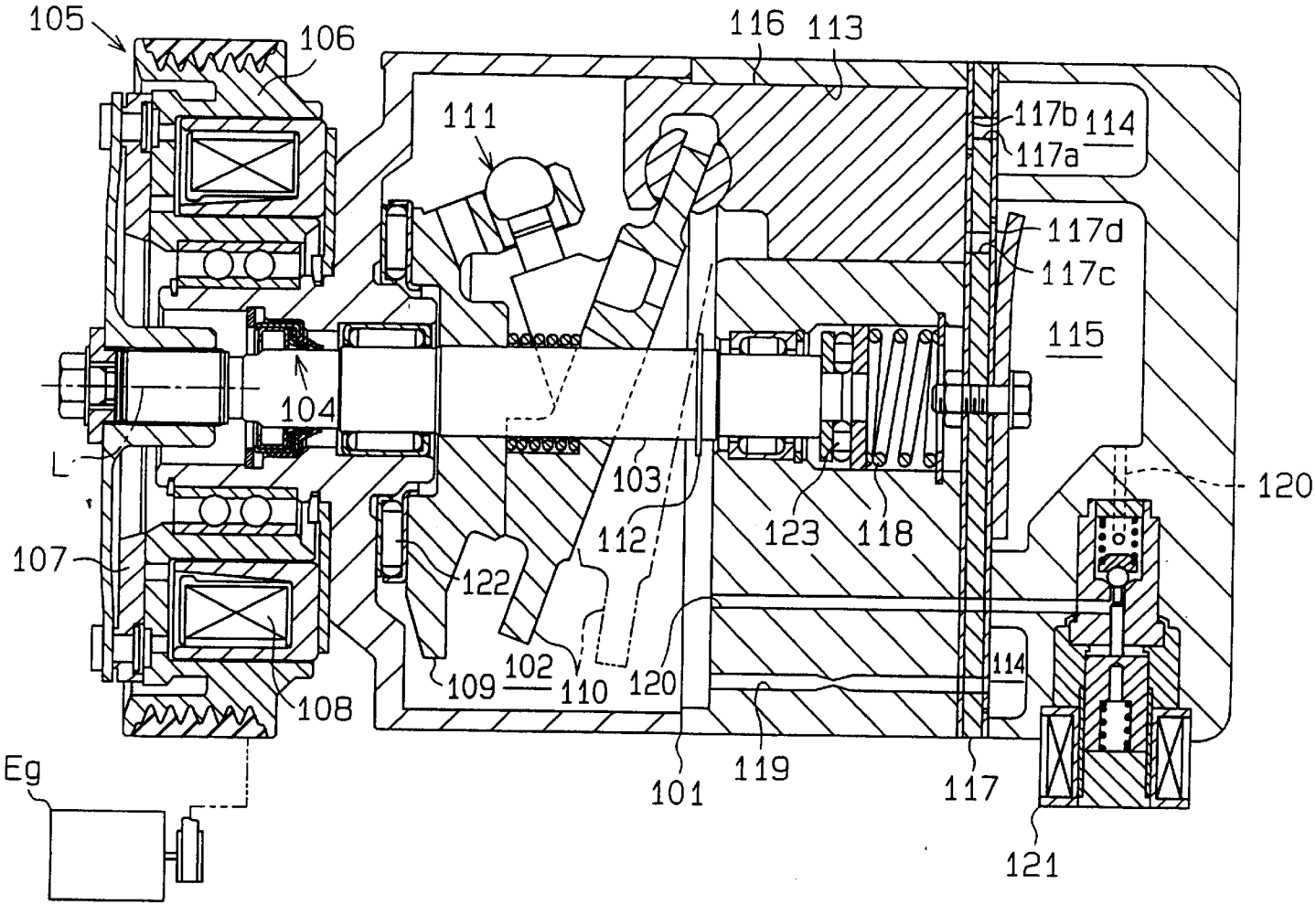
Fig.8(Prior Art)
FIG. 8 is a cross sectional view of a prior art variable displacement compressor.

A through hole 91*a* is formed in the release valve 91 and functions as a fixed restrictor of the bleed passage 45. The cross-sectional area of the through hole 91*a* is smaller than that of the bleed passage 45. When the difference between the pressure in the crank chamber 15 and the pressure in the suction chamber 37 is smaller than the predetermined value, or when the pressure difference is appropriate, the release valve 91 is closed as shown in FIG. 2(*a*). In this state, the crank chamber 15 is still connected to the suction chamber 37 via the through hole 91*a*. Accordingly, when the release valve 91 is closed, the flow of refrigerant gas in the bleed passage 45 is restricted by the through hole 91*a*, which ensures proper flow rate of refrigerant gas from the crank chamber 15 to the suction chamber 37. That is, when the release valve 91 is closed, the bleed passage 45 functions the same way as the bleed passage 119 of the prior art compressor shown in FIG. 8.

When the air-conditioner switch 80 is turned off during the operation of the compressor, the controller C stops the current supply to the coil 29 and disengages the clutch 23 and simultaneously stops the current supply to the coil 64 of the control valve 46.

When the gas pedal depression degree detected by the gas pedal sensor 83 is greater than a predetermined value during the operation of the compressor, the controller C judges that the vehicle is being quickly accelerated and stops the current supply to the coil 64 of the control valve 46 for a predetermined period.

When the engine Eg is stopped during the operation of the compressor, the current supply to the coil 29 is stopped and the clutch 23 is disengaged, and simultaneously, the current supply to the coil 64 of the control valve 46 is stopped.

When the clutch 23 is disengaged or the engine Eg is stopped, the current supply to the coil 64 of the control valve 46 is stopped. Then, the attraction force between the fixed core 60 and the movable core 61 disappears, and the control valve 46 fully opens the pressurizing passage 44. This increases the pressure in the crank chamber 15 and minimizes the inclination of the swash plate 31. As a result, the compressor is stopped when the inclination of the swash plate 31 is minimized, or when the displacement is minimized. Accordingly, since the compressor is started from the minimum displacement state, which produces a minimum torque load, the torque shock of starting the compressor is limited.

When the gas pedal depression degree detected by the gas pedal sensor 83 is greater than a predetermined value, the current supply to the coil 64 is stopped. This causes the control valve 46 to fully open the pressurizing passage 44. As a result, the inclination of the swash plate 31 is minimized and the compressor is operated at the minimum displacement with relatively low torque load. Therefore, the load on the engine Eg is reduced and the vehicle is smoothly accelerated.

When the current supply to the coil 64 is stopped while the compressor is operated at maximum displacement, the control valve 46 quickly maximizes the opening size of the closed pressurizing passage 44. This permits relatively high pressure refrigerant gas in the discharge chamber 38 to flow quickly to the crank chamber 15. Since the amount of refrigerant gas that flows from the crank chamber 15 to the suction chamber 37 through the bleed passage 45 and the through hole 91*a* of the release valve 91 is limited, the pressure in the crank chamber 15 is quickly increased.

However, as shown in FIG. 2(*b*), when the difference between the pressure of the crank chamber 15 and that of the suction chamber 37 is greater than a predetermined value, the release valve 91 is opened. This permits a relatively large amount of refrigerant gas to flow from the crank chamber 15 to the suction chamber 37 compared to that when the release valve 91 of FIG. 2(*a*) is closed. As a result, a sudden increase of the pressure in the crank chamber 15 is suppressed, and the swash plate 31 is prevented from being pressed against the limit ring 34 by excessive force when at its minimum inclination position. Also, the swash plate 31 does not strongly pull the lug plate 30 rearward (rightward in FIG. 1) through the hinge mechanism 32. As a result, the drive shaft 16 is prevented from moving axially rearward against the force of the axial spring 20.

When the vehicle is quickly accelerated while the compressor is operating at maximum displacement, the load on the engine Eg can be reduced by disengaging the clutch 23. However, shock is produced in engaging or disengaging the clutch 23, which lowers the performance. In contrast, the clutch 23 is not disengaged when the vehicle is quickly accelerated, which improves the performance.

The present embodiment has the following advantages.

An excessive increase of the pressure in the crank chamber 15 is prevented by opening the release valve 91 at the exit of the bleed passage 45. As a result, the drive shaft 16 is prevented from moving axially rearward against the force of the axial spring 20.

The drive shaft 16 does not move with respect to the lip seal 22. That is, the position of the drive shaft 16 with respect to the lip ring 22*a* of the lip seal 22 does not change. Therefore, sludge does not get in the space between the lip ring 22*a* and the drive shaft 16. This extends the life of the lip seal 22 and prevents leakage of gas from the crank chamber 15.

The armature 28 of the clutch 23 moves with respect to the rotor 24 in the direction of axis L and contacts or separates from the rotor 24. In the present embodiment, since the axially rearward movement of the drive shaft 16 is prevented, a desirable clearance 48 is ensured between the rotor 24 and the armature 28 when the clutch 23 is disengaged. Accordingly, power transmission between the rotor 24 and the armature 28 is disrupted without fail while the electromagnetic coil 29 of the clutch 23 is de-excited. This prevents noise, vibration, and heat that are caused by contact between the rotor 24 and the armature 28.

Each piston 35 is connected to the drive shaft 16 through the lug plate 30, the hinge mechanism 32, the swash plate 31 and the shoes 36. The axially rearward movement of the drive shaft 16 is prevented, which prevents the pistons 35 from moving toward the valve plate 14. As a result, the pistons 35 are prevented from colliding with the valve plate 14 at the top dead center position. Therefore, noise and vibration caused by the collision between the pistons 35 and the valve plate 14 are suppressed.

The opening size of the pressurizing passage 44 is varied by controller C based on the information including the passenger compartment temperature, the target temperature, and the gas pedal depression degree. Compared to a compressor having a control valve that operates in accordance with only suction pressure, sudden change of displacement from the maximum to the minimum can occur in a compressor including the control valve 46, that is, the pressure in the crank chamber 15 can be quickly increased. Therefore, the release valve 91 of the compressor of FIG. 1 effectively prevents sudden increases of the pressure in the crank chamber 15.

In addition to the original function, that is, the function of releasing the gas from the crank chamber with a proper restriction, the bleed passage 45 functions as a passage for preventing a sudden increase of the pressure in the crank chamber 15. Therefore, there is no need to form another passage for releasing the pressure in the crank chamber 15, which limits the manufacturing steps and simplifies the structure.

The release valve 91, which is a reed valve, is simpler than a spool valve or an electromagnetic valve and can be arranged in a relatively small space. Also, the release valve 91, which is a pressure difference valve, does not require an external control, which makes it simpler than, for example, an electromagnetic valve.

The release valve 91 is formed using the retainer plate 14*d*, which forms a part of the valve plate 14. Accordingly, the structure of the release valve 91 is simpler compared to a release valve that is independently formed from the valve plate 14.

The control valve 46 varies the displacement of the compressor by changing the flow rate of refrigerant gas from the discharge chamber 38 to the crank chamber 15 by changing the opening size of the pressurizing passage 44. The compressor of FIG. 1 can more quickly increase the pressure in the crank chamber 15 than a compressor that only adjusts the flow of refrigerant from the crank chamber 15 to the suction chamber 37 to vary the displacement. Accordingly, when the compressor is stopped, the displacement is quickly minimized. When the compressor is restarted right after the previous stop, the compressor is started at the minimum displacement without fail. The release valve 91 is especially effective for the compressor of FIG. 1, which tends to excessively increase the pressure in the crank chamber 15.

For example, the structure of the control valve 46 may be changed such that the attraction force between the fixed core 60 and the movable core 61 operates the valve body 52 to increase the opening size of the valve hole 53. In this case, the current supply from the power source S to the coil 64 must be maximized to minimize the displacement especially when the engine Eg is stopped. In other words, it is necessary to maintain the current supply line between the power source S and the coil 64. This requires a drastic change from the existing electrical systems.

In contrast, the control valve 46 of the present embodiment only stops the current supply from the power source S to the coil 64 to minimize the displacement when the engine Eg is stopped. Accordingly, it does not matter that the current supply line between the power source S and the coil 64 is disconnected when the engine Eg is stopped. Therefore, the displacement is minimized without changing the structure of existing vehicle electric systems.

Second Embodiment

Figure 5A:
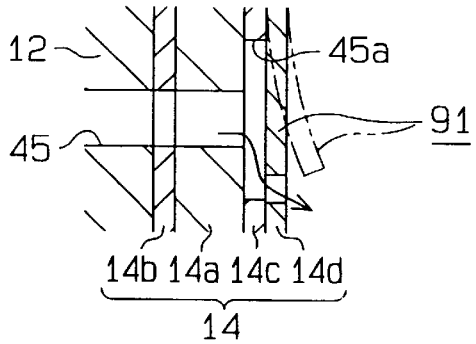
FIG. 5(*a*) is a partial enlarged cross-sectional view showing a release valve in a second embodiment of the present invention.
Figure 5B:
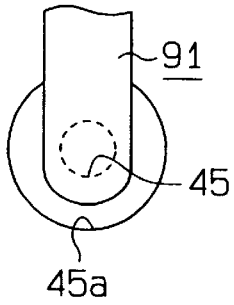

FIGS. 5(*a*), 5(*b*) show a release valve 91 of a second embodiment. In the second embodiment, the through hole 91*a* of the release valve 91 is omitted. Also, the bleed passage 45 has an exit 45*a*, which cannot be completely closed by the release valve 91. The exit 45*a* is formed on the valve plate 14 by spot facing. As shown in FIGS. 5(*a*), 5(*b*), a hole that is formed in the second sub-plate 14*c* functions as the exit 45*a*. When the release valve 91 is positioned at the closed position, a space is formed between the exit 45*a* and the release valve 91. When the difference between the pressure in the crank chamber 15 and the pressure in the suction chamber 37 is smaller than predetermined value, refrigerant gas in the crank chamber can flow to the suction chamber 37 through the bleed passage 45 and the space, which is properly restricted.

The present embodiment also prevents excessive increases of pressure in the crank chamber 15 like the first embodiment shown in FIGS. 1–4. The release valve 91, which does not have the through hole 91*a*, has improved durability.

Third Embodiment

Figure 6A:
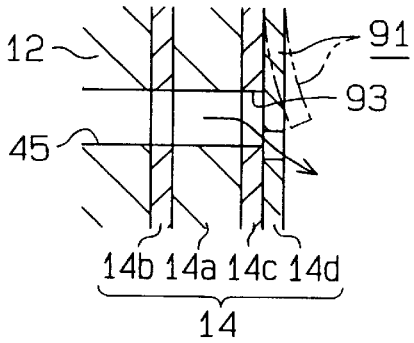
FIG. 6(*a*) is a partial enlarged cross-sectional view showing a release valve in a third embodiment.
Figure 6B:
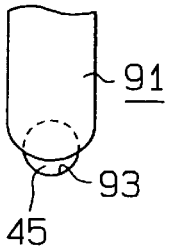

FIGS. 6(*a*) and 6(*b*) show a release valve of a third embodiment. In the third embodiment, the through hole 91*a* is omitted in the release valve 91 of FIG. 2(*a*). Also, the exit 93 of the bleed passage 45 is offset from the release valve 91. Accordingly, when the release valve 91 is positioned at the closed position, the exit 93 of the bleed passage 45 is not completely covered by the release valve 91.

The present embodiment has the same advantages as the first embodiment shown in FIGS. 1–4. Since the exit 93 is only offset from the release valve 91, the machining process for the through hole 91*a* shown in FIGS. 1–4 or spot facing for the exit 45*a* shown in FIG. 5 are not required, which lowers the manufacturing cost.

Figure 7A:
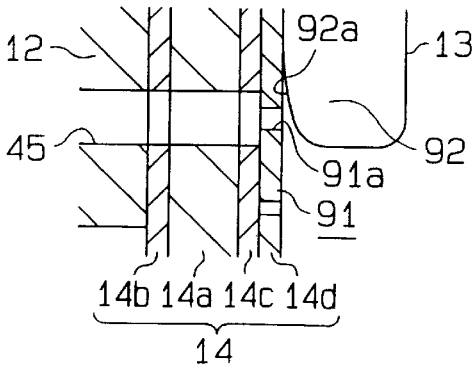
FIG. 7(*a*) is a partial enlarged cross-sectional view showing a release valve in a fourth embodiment.
Figure 7B:
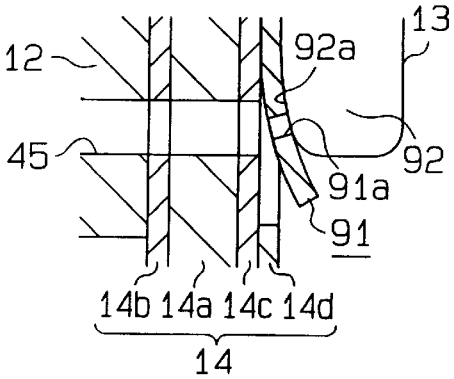

FIGS. 7(*a*) and 7(*b*) show a fourth embodiment. In the present embodiment, a retainer 92 for limiting the opening degree of the release valve 91 is provided in addition to the structure of the first embodiment shown in FIGS. 1–4. The retainer 92 is formed, for example, integrally with an inner wall of the rear housing member 13 that forms the inner surface of the suction chamber 37. The retainer 92 includes a limit surface 92*a*, which is curved to correspond to the curve of the opened release valve 91.

The opened release valve 91 is supported by the retainer 92. Accordingly, the release valve 91 is prevented from curving more than required, which improves the durability of the release valve 91. Also, the retainer 92 determines the maximum opening degree of the release valve 91, which facilitates adjusting the crank chamber pressure characteristics.

The retainer 92 is integrally formed in the rear housing member 13, which reduces the number of parts and manufacturing steps compared to providing an independent retainer 92. The curved release valve 91 is entirely and securely supported by the curved limit surface 92*a* of the retainer 92, which improves the durability of the release valve 91.

The illustrated embodiments can be varied as follows.

An independent release passage for releasing excessive pressure in the crank chamber 15 may be provided in addition to a bleed passage that does not have the release valve 91. In this case, when the difference between the pressure in the crank chamber 15 and the pressure in the suction chamber 37 is smaller than predetermined value, the independent release passage is completely closed by a reed valve and a proper amount of refrigerant gas flows from the crank chamber 15 to the suction chamber 37 through the bleed passage 45. When the pressure in the crank chamber reached a certain level, the reed valve opens the independent release passage.

A pressure limiting passage may be provided between the discharge chamber 38 and the crank chamber to prevent excessive increases of the pressure in the crank chamber 15. In this case, the limiting passage is independent from the pressurizing passage. When the pressure in the crank chamber 15 increases excessively, a pressure limiting valve, which is a reed valve, reduces or completely closes the opening of the limiting passage to limit the flow of refrigerant gas to the crank chamber 15.

The present invention may be applied to a compressor that varies the displacement by adjusting the flow of refrigerant gas from the crank chamber 15 to the suction chamber 37 by the control valve 46. In this case, the control valve 46 is located in a passage that connects the crank chamber 15 to the suction passage 37.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A variable displacement compressor comprising:

a housing including a cylinder bore, a crank chamber, a suction chamber, and a discharge chamber;

a piston accommodated in the cylinder bore;

a drive shaft rotatably supported in the housing;

a drive plate coupled to the piston for converting rotation of the drive shaft to reciprocation of the piston, the drive plate being tiltably supported on the drive shaft, wherein the drive plate moves between a maximum inclination and a minimum inclination in accordance with the pressure in the crank chamber, wherein the inclination of the drive plate determines the piston stroke and the displacement of the compressor;

a pressure control mechanism for controlling the pressure in the crank chamber to change the inclination of the drive plate;

a control passage for connecting the crank chamber to a selected chamber in the compressor; and a reed valve located in the control passage, wherein the reed valve varies the opening of the control passage in accordance with the difference between the pressure in the crank chamber and the pressure in the selected chamber, which limits the pressure in the crank chamber.

2. The compressor according to claim 1, wherein the compressor includes an urging member that urges the drive shaft in the axial direction, which regulates the axial movement of the drive shaft, wherein the pressure in the crank chamber applies an axial force to the drive plate to press the drive shaft in the axial direction when the drive plate is located at the minimum inclination, wherein the reed valve limits the pressure in the crank chamber such that the axial force cannot move the drive shaft against the force of the urging member.

3. The compressor according to claim 1, wherein the pressure control mechanism includes:

a pressurizing passage for connecting the discharge passage to the crank chamber;

a control valve located in the pressurizing passage, which controls a flow of gas from the discharge chamber to the crank chamber through the pressurizing passage, wherein the control valve substantially fully opens the pressurizing passage, which moves the drive plate to the minimum inclination based on commands from the external of the compressor.

4. The compressor according to claim 1, wherein the selected chamber is the suction chamber, wherein the control passage allows flow of gas from the crank chamber to the suction chamber, wherein the reed valve opens to increase the flow of the gas in the control passage if the difference between the pressure in the crank chamber and the pressure in the suction chamber is greater than a predetermined value.

5. The compressor according to claim 4, wherein the control passage always connects the crank chamber to the suction chamber, which allows the flow of the gas from the crank chamber to the suction chamber.

6. The compressor of claim 5, wherein the reed valve is closed to limit the flow of the gas in the control passage if the difference between the pressure in the crank chamber and the pressure in the suction chamber is smaller than the predetermined value.

7. The compressor according to claim 6, wherein the reed valve has a restricted opening, the cross sectional area of which is smaller than that of the control passage, wherein the flow of the gas in the control passage is restricted by the restricted opening if the reed valve is closed.

8. The compressor according to claim 1, wherein the housing includes a cylinder block, in which has the cylinder bore is formed, and a housing member coupled to the cylinder block, wherein the suction chamber and the discharge chamber are formed in the housing member, wherein a valve plate is located between the cylinder block and the housing member such that the valve plate separates the cylinder bore from the suction chamber and the discharge chamber, wherein the piston draws gas from the suction chamber to the cylinder bore through the valve plate and forces gas from the cylinder bore to the discharge chamber through the valve plate, wherein the control passage passes through the valve plate, and wherein the reed valve is located on the valve plate.

9. The compressor according to claim 1, wherein the compressor has a retainer for limiting the maximum opening degree of the reed valve.

10. The compressor according to claim 9, wherein the retainer is formed integrally with the housing.

11. The compressor according to claim 9, wherein the retainer has a curved surface that contacts the reed valve.

12. A variable displacement compressor comprising:

a housing including a cylinder bore, a crank chamber, a suction chamber, and a discharge chamber;

a piston accommodated in the cylinder bore;

a drive shaft rotatably supported in the housing;

a drive plate coupled to the piston for converting rotation of the drive shaft to reciprocation of the piston, the drive plate being tiltably supported on the drive shaft, wherein the drive plate moves between a maximum inclination and a minimum inclination in accordance with the pressure in the crank chamber, wherein the inclination of the drive plate determines the piston stroke and the displacement of the compressor;

a pressurizing passage for connecting the discharge chamber to the crank chamber;

a control valve located in the pressurizing passage, which controls a flow of gas from the discharge chamber to the crank chamber through the pressurizing passage;

a bleed passage that always connects the crank chamber to the suction chamber, which allows gas to flow from the crank chamber to the suction chamber; and a reed valve located in the bleed passage, wherein the reed valve is closed to limit the flow of the gas in the control passage if the difference between the pressure in the crank chamber and the pressure in the suction chamber is smaller than a predetermined value, and the reed valve is opened to increase the flow of the gas in the bleed passage if the difference between the pressure in the crank chamber and the pressure in the suction chamber is greater than the predetermined value.

13. The compressor according to claim 12, wherein the compressor includes an urging member that urges the drive shaft in the axial direction, which regulates the axial movement of the drive shaft, wherein the pressure in the crank chamber applies an axial force to the drive plate to press the drive shaft in the axial direction when the drive plate is located at the minimum inclination, wherein the reed valve limits the pressure in the crank chamber such that the axial force cannot move the drive shaft against the force of the urging member.

14. The compressor according to claim 12, wherein the control valve substantially fully opens the pressurizing passage, which moves the drive plate to the minimum inclination based on commands from the external of the compressor.

15. The compressor according to claim 12, wherein the reed valve has a restricted opening, the cross sectional area of which is smaller than that of the bleed passage, wherein the flow of the gas in the bleed passage is restricted by the restricted opening if the reed valve is closed.

16. The compressor according to claim 12, wherein the housing includes a cylinder block, in which the cylinder bore is formed, and a housing member coupled to the cylinder block, wherein the suction chamber and the discharge chamber are formed in the housing member, wherein a valve plate is located between the cylinder block and the housing member such that the valve plate separates the cylinder bore from the suction chamber and the discharge chamber, wherein the piston draws gas from the suction chamber to the cylinder bore through the valve plate and forces gas from the cylinder bore to the discharge chamber through the valve plate, wherein the bleed passage has an outlet formed in the valve plate such that the outlet opens in the suction chamber, wherein the reed valve is located on the valve plate to change the opening of the outlet.

17. The compressor according to claim 12, wherein the compressor has a retainer for limiting the maximum opening degree of the reed valve.

18. The compressor according to claim 17, wherein the retainer is formed integrally with the housing.

19. The compressor according to claim 17, wherein the retainer has a curved surface that contacts the reed valve.

20. A variable displacement compressor comprising:

a housing including a cylinder bore, a crank chamber, a suction chamber, and a discharge chamber;

a piston accommodated in the cylinder bore;

a drive shaft rotatably supported in the housing;

an urging member that urges the drive shaft in the axial direction, which regulates the axial movement of the drive shaft;

a drive plate coupled to the piston for converting rotation of the drive shaft to reciprocation of the piston, the drive plate being tiltably supported on the drive shaft, wherein the drive plate moves between a maximum inclination and a minimum inclination in accordance with the pressure in the crank chamber, wherein the inclination of the drive plate determines the piston stroke and the displacement of the compressor, wherein the pressure in the crank chamber applies an axial force to the drive plate to press the drive shaft in the axial direction when the drive plate is located at the minimum inclination;

a pressurizing passage for connecting the discharge chamber to the crank chamber;

a control valve located in the pressurizing passage, which controls a flow of gas from the discharge chamber to the crank chamber through the pressurizing passage;

a pressure release passage for connecting the crank chamber to the suction chamber, which allows gas to flow from the crank chamber to the suction chamber; and a reed valve located in the release passage to control the openings of the release passage, wherein the reed valve limits the pressure in the crank chamber such that the axial force cannot move the drive shaft against the force of the urging member.

* * * * *